US010006182B1

(12) United States Patent
Cho et al.

(10) Patent No.: US 10,006,182 B1
(45) Date of Patent: Jun. 26, 2018

(54) SNOW REMOVAL APPARATUS HAVING IMPROVED DISSOLUTION EFFICIENCY

(71) Applicant: DAEJI PRECISION INDUSTRIES COMPANY LIMITED, Yongin-si, Gyeonggi-do (KR)

(72) Inventors: Hang Woo Cho, Seongnam-si (KR); Hyo Sang Cho, Yongin-si (KR)

(73) Assignee: DAEJI PRECISION INDUSTRIES COMPANY LIMITED, Yongin-si, Gyeonggi-do (KR)

( * ) Notice: Subject to any disclaimer, the term of this patent is extended or adjusted under 35 U.S.C. 154(b) by 0 days. days.

(21) Appl. No.: 15/646,471

(22) Filed: Jul. 11, 2017

(51) Int. Cl.
*E01H 5/10* (2006.01)
*E01H 5/09* (2006.01)

(52) U.S. Cl.
CPC ..... *E01H 5/104* (2013.01); *E01H 5/098* (2013.01)

(58) Field of Classification Search
CPC ..... E01H 5/104; E01H 5/098; E01H 5/10; E01H 5/102; E01H 5/106; E01H 5/108
See application file for complete search history.

(56) References Cited

U.S. PATENT DOCUMENTS 1,242,433 A * 10/1917 Friedman ..... E01H 5/104 126/343.5 R
1,602,476 A * 10/1926 Ballard ..... E01H 5/104 126/343.5 R
2,599,098 A * 6/1952 Flynn ..... E01H 5/104 126/343.5 R
2,783,554 A * 3/1957 Schmitz ..... E01H 5/04 37/229
2,877,762 A * 3/1959 Flynn ..... E01H 5/104 126/343.5 R
3,304,632 A * 2/1967 Kotlar ..... E01H 5/104 126/343.5 R
3,404,470 A * 10/1968 Raiti ..... B65F 3/18 126/343.5 R
3,619,918 A * 11/1971 Morin ..... E01H 5/104 126/343.5 R
4,071,966 A * 2/1978 Cohen ..... E01H 5/098 193/31 A
4,164,820 A * 8/1979 Krickovich ..... E01H 1/0845 15/340.3
4,785,561 A * 11/1988 Swanson ..... E01H 5/104 126/343.5 R
5,588,231 A * 12/1996 Mavrianos ..... E01H 5/104 126/343.5 R (Continued)

FOREIGN PATENT DOCUMENTS

KR 10-2006-0108297 A 10/2006
KR 10-1478681 B1 1/2015

*Primary Examiner* — Jamie L McGowan
(74) *Attorney, Agent, or Firm* — Rabin & Berdo, P.C.

(57) ABSTRACT

A snow removal apparatus having improved dissolution efficiency in which dissolution efficiency is improved by rapidly processing dry snow and wet snow using a suction unit and plurality dissolution units. The snow removal apparatus having improved dissolution efficiency includes a snow suction unit provided with a stirring portion configured to forcibly crush and stir external snow and a suction portion configured to forcibly suction the snow stirred by the stirring portion, a storage tank, a hopper, a first dissolution unit, a second dissolution unit, and a third dissolution unit.

7 Claims, 11 Drawing Sheets

(56) References Cited

U.S. PATENT DOCUMENTS

| | | | | |
|---|---|---|---|---|
| 6,305,105 | B1 * | 10/2001 | Lowman | E01H 5/104 37/199 |
| 6,904,708 | B2 * | 6/2005 | Rogers | E01H 5/104 126/343.5 R |
| 9,732,489 | B1 * | 8/2017 | Whitney | E01H 5/104 |
| 2017/0152639 | A1 * | 6/2017 | Cho | E01H 5/104 |

* cited by examiner

SNOW REMOVAL APPARATUS HAVING IMPROVED DISSOLUTION EFFICIENCY

BACKGROUND

1. Field of the Invention

The present invention relates to a snow removal apparatus having improved dissolution efficiency, and more particularly to, a snow removal apparatus having improved dissolution efficiency in which dry snow and wet snow are rapidly processed by a suction unit and a plurality of dissolution units to improve dissolution efficiency thereof.

2. Discussion of Related Art

Generally, a method for removing snow accumulated on a road in winter includes a method in which a vehicle loads calcium chloride or a chloride solution loaded in a loading box and applies the calcium chloride or chloride solution using an applier while traveling on a road, a method in which a vehicle having a snow remover on a front thereof pushes snow cover to a side of a road while traveling on a road, a method in which a snow blower (a blower type snow remover) forcibly suctions a relatively large amount of snowfall and throws the snow to a side of a road, and a method in which hot air blown from a vehicle dissolves snow on a road.

Among the above methods, the method of applying calcium chloride or a chloride solution has a problem in that it takes considerable time to cause a chemical reaction with snow, the method of pushing snow cover to a side of a road or using a snow blower meets a purpose of snow removal for emergency traffic but only moves snow cover to an adjacent area of a road by scattering the snow cover, and thus has a problem in that the snow cover is not fundamentally removed, and the method of dissolving snow on a road using hot air may obtain an excellent dissolution effect in the case in which a small amount of snowfall is accumulated, but has a problem in that a dissolution effect due to the hot air is lowered in the case in which a large amount of snowfall is accumulated or frozen.

As examples of a snow removal apparatus for solving the problems, "Apparatus for removing snow through liquefaction" in Korea Laid-Open Patent Publication No. 10-2006-0108297, (hereinafter, referred to as Prior Art 1) and "Apparatus for removing snow through liquefaction" in Korean Patent No. 10-1478681 (hereinafter, referred to as Prior Art 2).

Prior Art 1 has a problem in that because snow is dropped into a snow removal room and is liquefied by a heat line, a large amount of heat for liquefying snow is required such that a separate hot air blower has to be driven, and thus energy consumption is high.

In Prior Art 2, which is an improved version of Prior Art 1 and is an invention previously registered by the present inventor, a water spray unit sprays water, which is stored in a storage part, onto snow, which is suctioned by a snow suction unit, and the water stored in the storage part is heated by a heating unit to be supplied to a water supply unit, and the snow, which is suctioned by the snow suction unit, is melted by the water, and thus energy efficiency is improved.

However, there are problems in that wet snow containing moisture is relatively difficult to suction using the suction unit and melting the wet snow by spraying water thereon uses a large amount of energy in comparison to dry powder type snow which is easy to suction and melt.

For reference, the term "liquefaction" is conventionally used to mean snow being turned into water, but the term "liquefaction" has been changed to "dissolution" in the present invention because "dissolution" includes a meaning in which snow melts in water.

PRIOR ART DOCUMENT

Patent Document

Patent Document 0001: Korea Laid-Open Patent Publication No. 10-2006-0108297, "Apparatus for removing snow through liquefaction"

Patent Document 0002: Korean Patent No. 10-1478681, "Apparatus for removing snow through liquefaction"

SUMMARY OF THE INVENTION

The present invention is directed to a snow removal apparatus having improved dissolution efficiency in which dry snow and wet snow are rapidly processed by a suction unit and a plurality of dissolution units to improve dissolution efficiency thereof.

According to an aspect of the present invention, there is provided a snow removal apparatus having improved dissolution efficiency including a snow suction unit provided with a stirring portion configured to forcibly crush and stir external snow and a suction portion configured to forcibly suction the snow stirred by the stirring portion, a storage tank in which a plurality of heaters are installed to melt the snow suctioned by the snow suction unit into water, and which stores the water, a hopper which is installed above the storage tank, and into which the snow suctioned by the snow suction unit is input, a first dissolution unit including a first pump configured to suction the water in the storage tank to spray the water to the snow on the hopper and driven by a first auxiliary engine, a second dissolution unit including a second pump configured to suction the water in the storage tank and spray the water onto snow falling from the hopper through a venturi tube and driven by a second auxiliary engine, wherein the venturi tube, which has an inner fluid pasage having a cross section which is smaller than those of an inlet and an outlet thereof, and is installed below a through hole of the hopper, and a third dissolution unit including a heating plate located below the venturi tube and coupled in a zigzag manner to at least one exhaust gas pipe line among exhaust gas pipe lines configured to circulate exhaust heat of the first auxiliary engine and the second auxiliary engine, wherein the at least one exhaust gas pipe line among the exhaust gas pipe lines configured to circulate the exhaust heat of the first auxiliary engine and the second auxiliary engine is located below the hopper, and the suction portion is provided with a screw configured to vertically raise the snow crushed by the stirring portion and a blower configured to transfer the snow introduced thereto by the screw to the hopper.

The snow removal apparatus may further include a third pump driven by a third auxiliary engine and configured to suction the water in the storage tank and supply the water to a water discharge outlet, which is configured to discharge the water to the outside.

The storage tank may be dividable into a dissolution tank and an auxiliary tank, and water may be stored in the auxiliary tank when a water level of the dissolution tank is raised.

A crushing net may be further installed in front of the outlet of the venturi tube.

The snow removal apparatus may further include a moving unit on which the snow suction unit, the storage tank, the hopper, the first dissolution unit, the second dissolution unit, and the third dissolution unit are installable and which is movable.

The moving unit may be provided as a vehicle.

A heater may be installed in the exhaust gas pipe line.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, embodiments of the present invention will be described in detail with reference to the accompanying drawings to be easily implemented by those skilled in the art. However, various different modifications thereof may be made, and the present invention is not limited to the embodiments.

Hereinafter, a structure and actions regarding the present invention will be described in detail with reference to the accompanying drawings.

Figure 1:
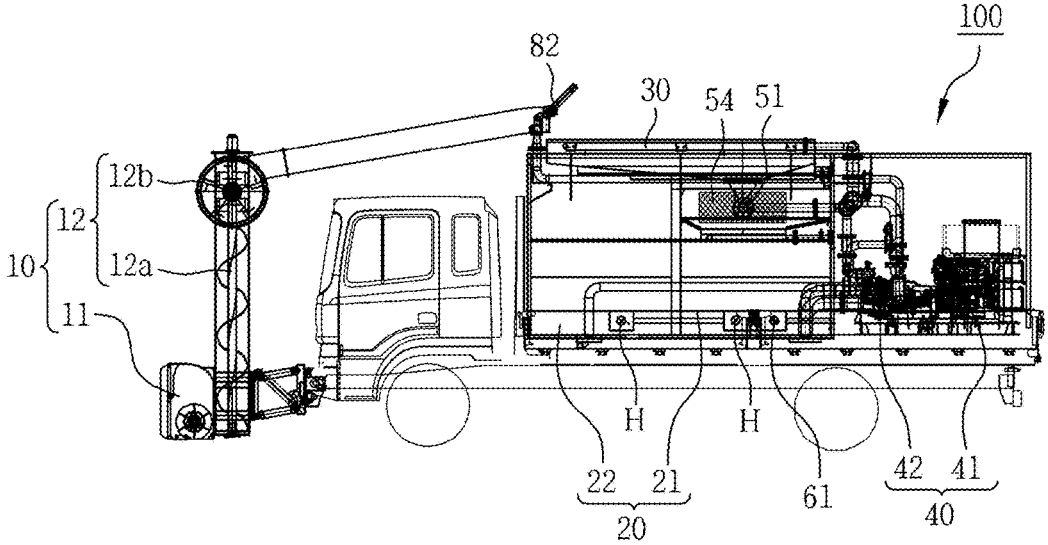
FIG. 1 is a side view illustrating a snow removal apparatus having improved dissolution efficiency according to the present invention.
Figure 2:
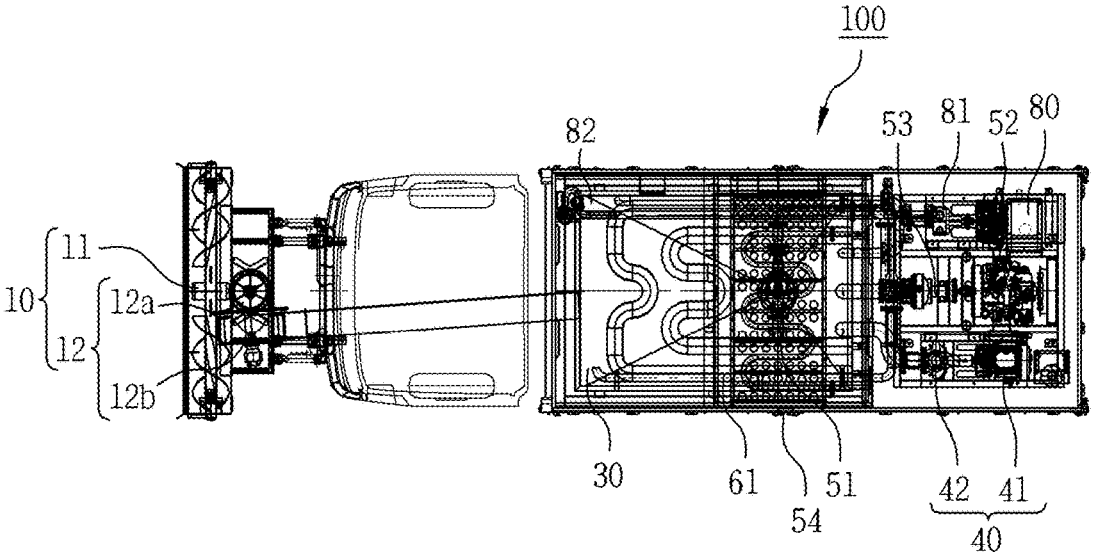
FIG. 2 is a plan view illustrating the snow removal apparatus having improved dissolution efficiency according to the present invention.
Figure 3:
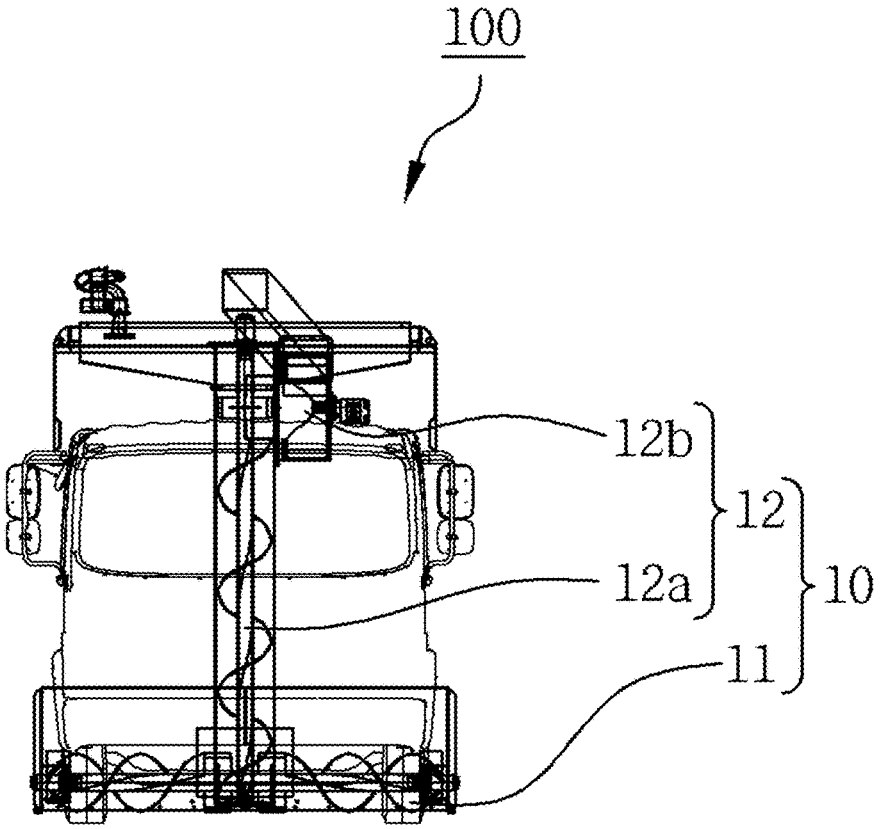
FIG. 3 is a front view illustrating the snow removal apparatus having improved dissolution efficiency according to the present invention.
Figure 4:
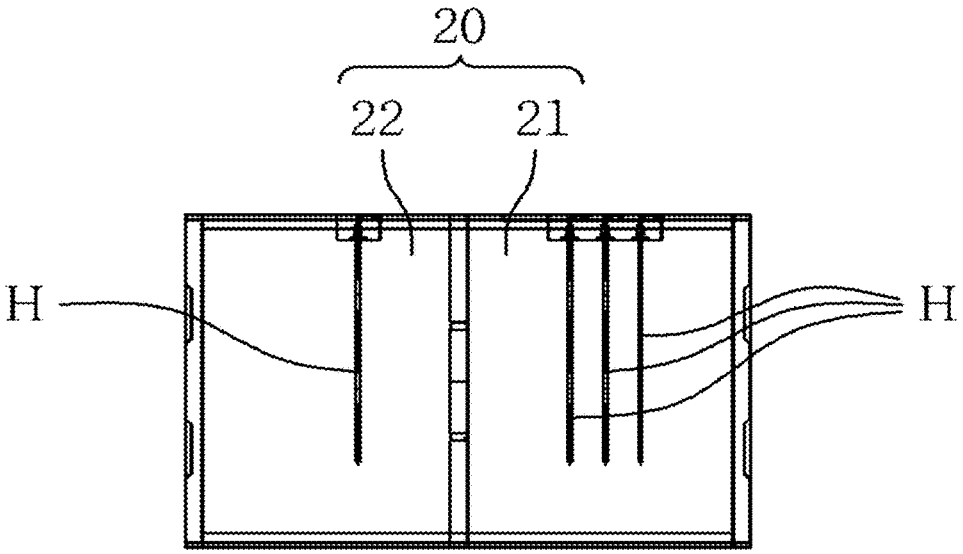
FIG. 4 is a plan view illustrating the storage tank of the snow removal apparatus having improved dissolution efficiency according to the present invention.
Figure 5:
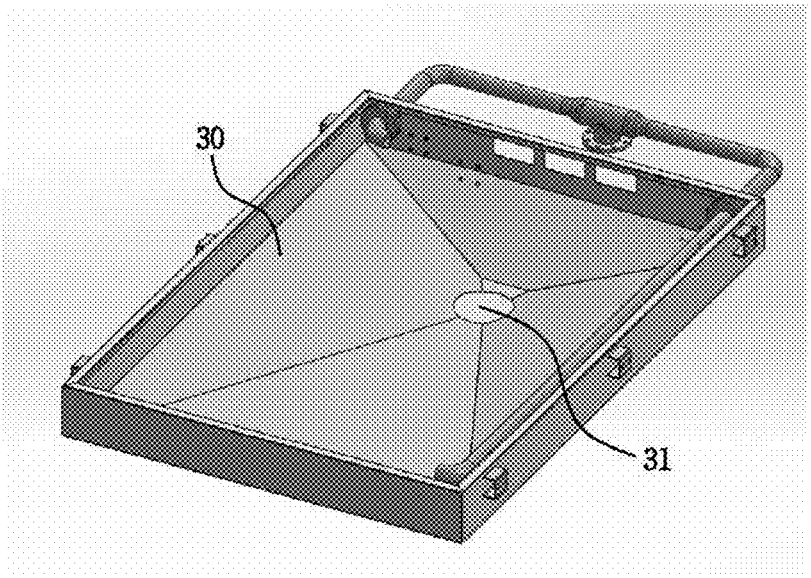
FIG. 5 is a perspective view illustrating a hopper of the snow removal apparatus having improved dissolution efficiency according to the present invention.
Figure 6:
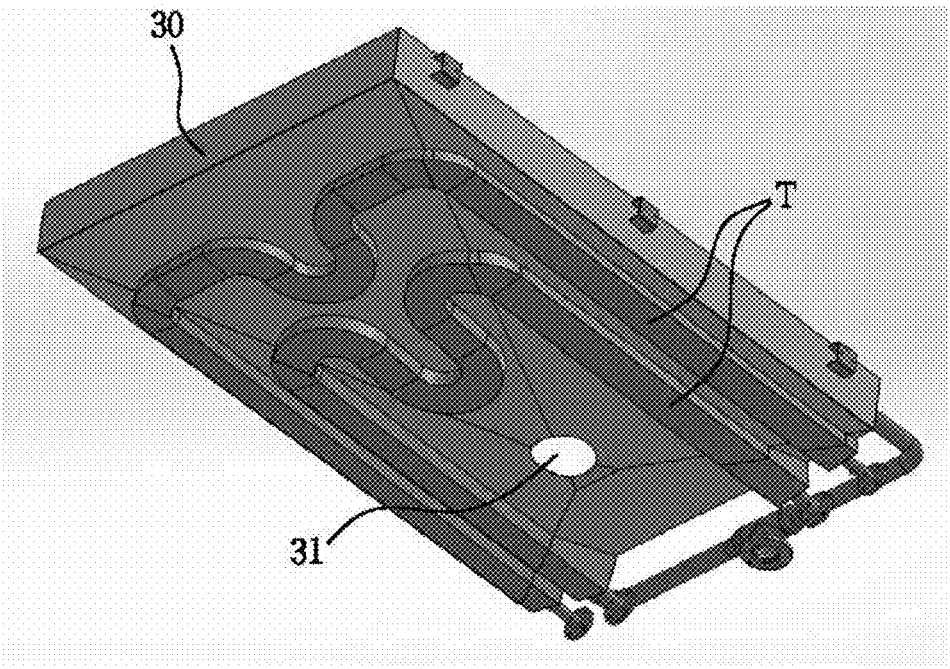
FIG. 6 is a bottom perspective view illustrating the hopper of the snow removal apparatus having improved dissolution efficiency according to the present invention.
Figure 7:
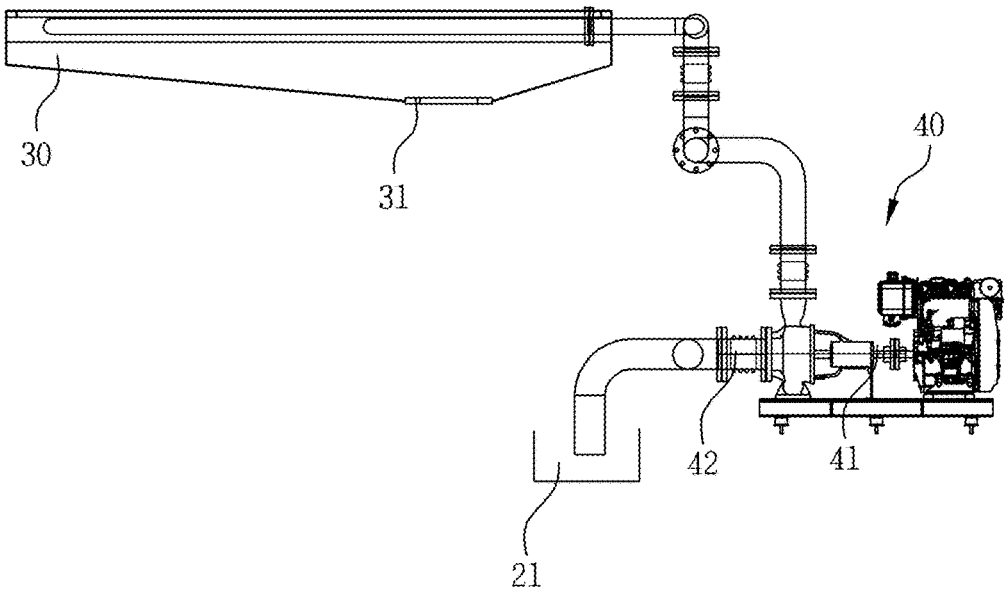
FIG. 7 is a front view illustrating a first dissolution unit of the snow removal apparatus having improved dissolution efficiency according to the present invention.
Figure 8:
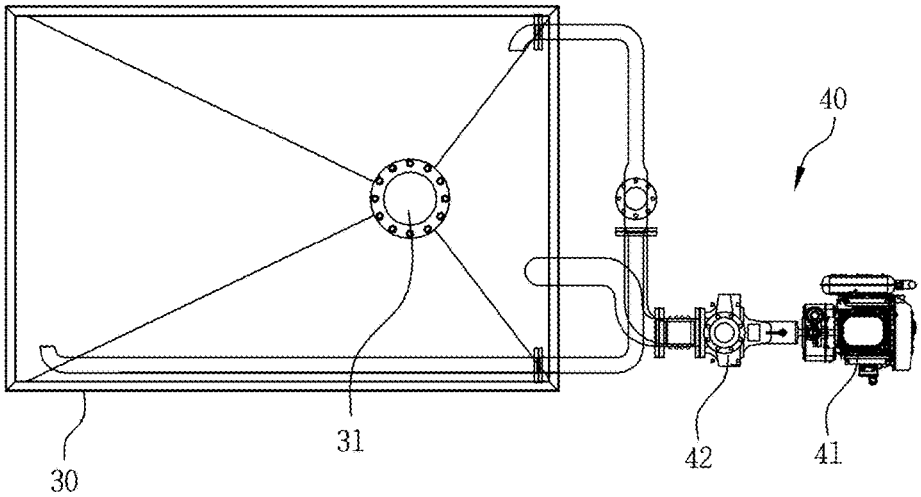
FIG. 8 is a plan view illustrating the first dissolution unit of the snow removal apparatus having improved dissolution efficiency according to the present invention.
Figure 9:
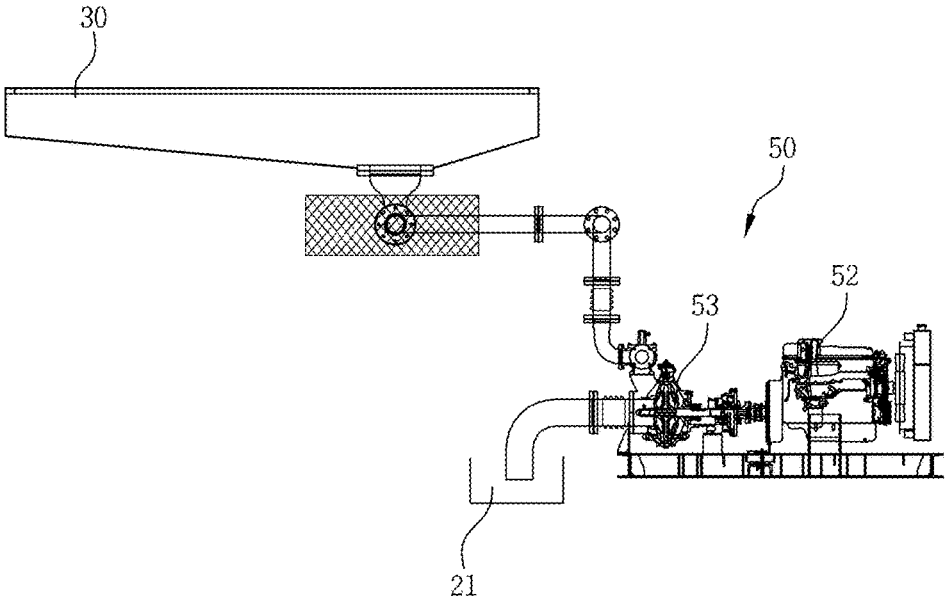
FIG. 9 is a front view illustrating a second dissolution unit of the snow removal apparatus having improved dissolution efficiency according to the present invention.
Figure 10:
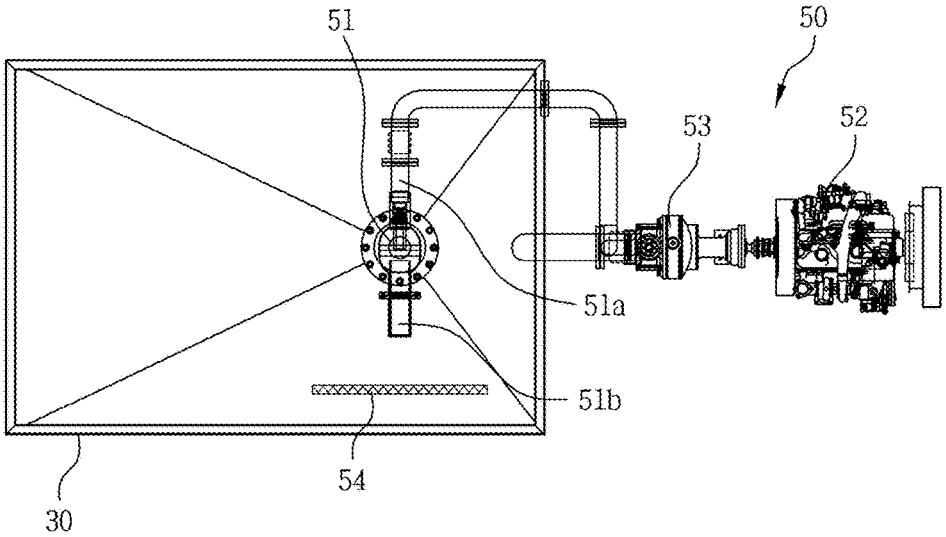
FIG. 10 is a plan view illustrating the second dissolution unit of the snow removal apparatus having improved dissolution efficiency according to the present invention.
Figure 11:
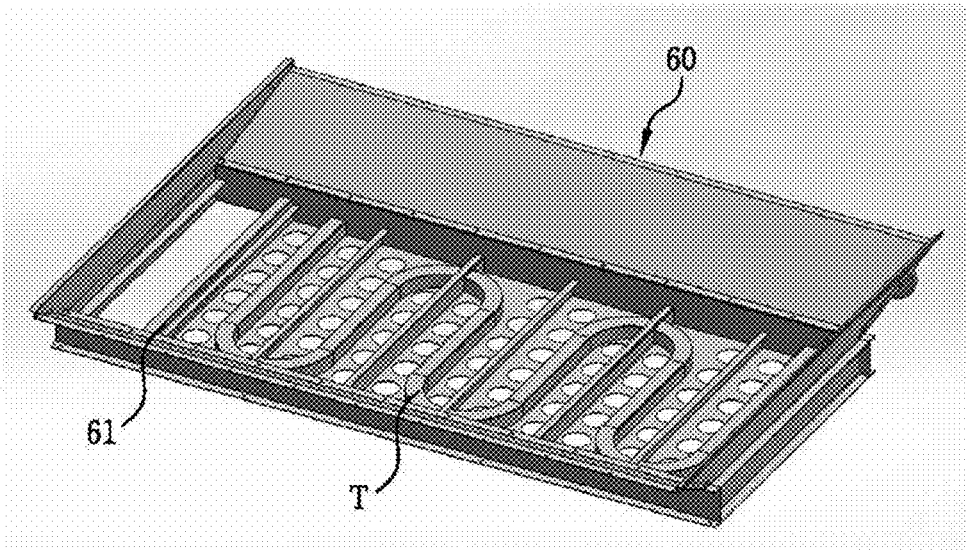
FIG. 11 is a perspective view illustrating a third dissolution unit of the snow removal apparatus having improved dissolution efficiency according to the present invention.
Figure 12:
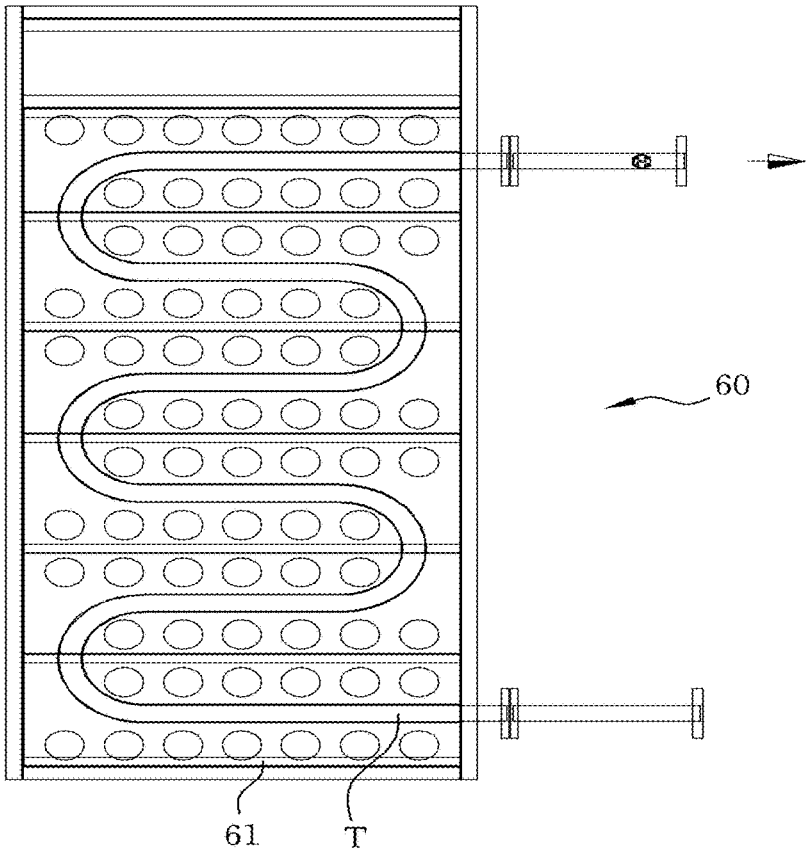
FIG. 12 is a plan view illustrating the third dissolution unit of the snow removal apparatus having improved dissolution efficiency according to the present invention.
Figure 13:
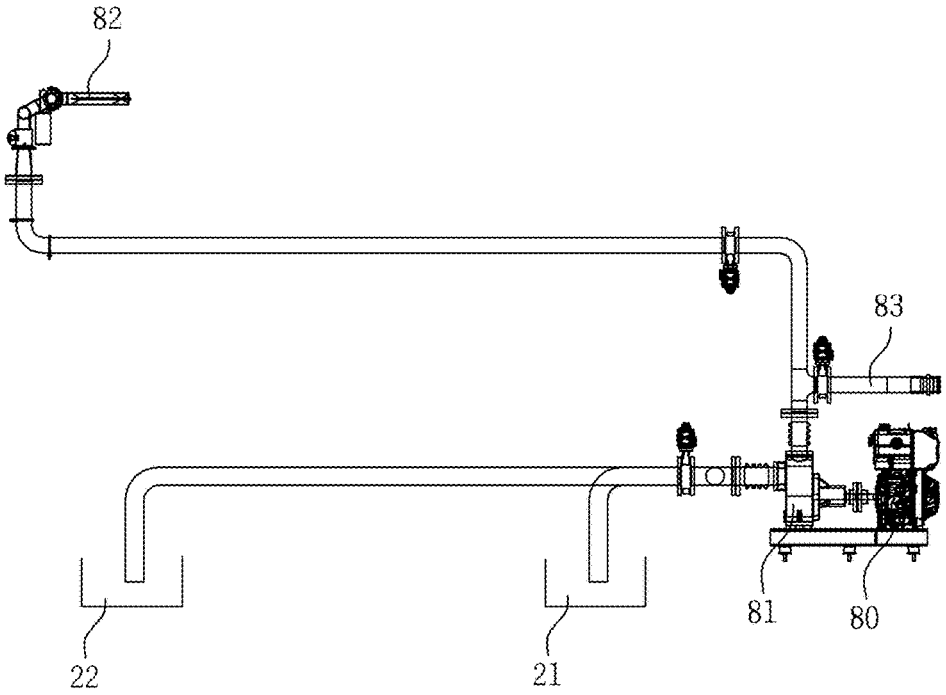
FIG. 13 is a view for describing a state in which water is supplied to a water discharge outlet of the snow removal apparatus having improved dissolution efficiency according to the present invention.

FIG. 1 is a side view illustrating a snow removal apparatus having improved dissolution efficiency according to the present invention, FIG. 2 is a plan view illustrating the snow removal apparatus having improved dissolution efficiency according to the present invention, FIG. 3 is a front view illustrating the snow removal apparatus having improved dissolution efficiency according to the present invention, FIG. 4 is a plan view illustrating a storage tank of the snow removal apparatus having improved dissolution efficiency according to the present invention, FIG. 4 is a plan view illustrating the storage tank of the snow removal apparatus having improved dissolution efficiency according to the present invention, FIG. 5 is a perspective view illustrating a hopper of the snow removal apparatus having improved dissolution efficiency according to the present invention, FIG. 6 is a bottom perspective view illustrating the hopper of the snow removal apparatus having improved dissolution efficiency according to the present invention, FIG. 7 is a front view illustrating a first dissolution unit of the snow removal apparatus having improved dissolution efficiency according to the present invention, FIG. 8 is a plan view illustrating the first dissolution unit of the snow removal apparatus having improved dissolution efficiency according to the present invention, FIG. 9 is a front view illustrating a second dissolution unit of the snow removal apparatus having improved dissolution efficiency according to the present invention, FIG. 10 is a plan view illustrating the second dissolution unit of the snow removal apparatus having improved dissolution efficiency according to the present invention, FIG. 11 is a perspective view illustrating a third dissolution unit of the snow removal apparatus having improved dissolution efficiency according to the present invention, FIG. 12 is a plan view illustrating the third dissolution unit of the snow removal apparatus having improved dissolution efficiency according to the present invention, and FIG. 13 is a view for describing a state in which water is supplied to a water discharge outlet of the snow removal apparatus having improved dissolution efficiency according to the present invention.

Referring to FIGS. 1 to 13, a snow removal apparatus 100 having improved dissolution efficiency of the present invention includes a snow suction unit 10, a storage tank 20, a hopper 30, a first dissolution unit 40, a second dissolution unit 50, and a third dissolution unit 60.

The snow suction unit 10 is formed with a stirring portion 11 configured to forcibly crush and stir external snow and a suction portion 12 configured to suction the snow stirred by the stirring portion 11.

In addition, it is preferable that the stirring portion 11 be formed as a screw type auger and configured to allow wet snow containing moisture to be easily suctioned.

In addition, the suction portion 12 may be provided with a screw 12*a* configured to vertically raise the snow stirred by the stirring portion and a blower 12*b* configured to transfer snow introduced thereto by the screw 12*a* to the hopper 30, but is not limited thererto. The suction portion 12 may transfer snow only using a screw, or may also transfer snow only using a blower.

A plurality of heaters H are installed in the storage tank 20 to melt snow suctioned by the snow suction unit 10 into water such that the water is stored therein.

In addition, it is preferable that the storage tank 20 be dividable into a dissolution tank 21 and an auxiliary tank 22, and water is stored in the auxiliary tank 22 when a water level of the dissolution tank 21 is raised.

The hopper 30, which is installed above the storage tank 20 and into which snow suctioned by the snow suction unit 10 is input, has an open upper portion and a lower portion including a through hole 31 formed therein such that the snow or water moves toward the storage tank 20.

The first dissolution unit 40 includes a first pump 42 configured to suction and spray water in the storage tank 20 to spray the water onto snow in the hopper 30 and driven by a first auxiliary engine 41.

That is, the first dissolution unit 40 dissolves snow by supplying the water in the storage tank 20, which is sprayed from the first pump 42 through a pipe line, into the hopper 30.

The second dissolution unit 50 includes a second pump 53 configured to suction the water in the storage tank 20 and spray the water through a venturi tube 51 on snow falling from the hopper 30 and driven by a second auxiliary engine 52, wherein the venturi tube 51, which has an inner fluid passage having a cross section which is smaller than those of an inlet 51*a* and an outlet 51*b* thereof, is installed below the through hole 31 of the hopper 30.

In addition, a crushing net 54 is also installed in front of the outlet 51*b* of the venturi tube 51, such that snow particles are crushed into small pieces having sizes similar to that of the crushing net 54.

The third dissolution unit 60 includes a heating plate 61 which is located below the venturi tube 51 and coupled in a zigzag manner to at least one exhaust gas pipe line T among exhaust gas pipe lines T configured to circulate exhaust heat of the first auxiliary engine 41 and the second auxiliary engine 52.

Here, exhaust heat of a third auxiliary engine 80, which will be described below, may also be transferred to the heating plate 61 using a separate exhaust gas pipe line T.

In addition, a separate ceramic heater may be installed in the exhaust gas pipe line T to raise a heating temperature.

In addition, the snow removal apparatus 100 having improved dissolution efficiency includes a moving unit 70 capable of moving the snow suction unit 10, the storage tank 20, the hopper 30, the first dissolution unit 40, the second dissolution unit 50, and the third dissolution unit 60 installed thereon. It is preferable that the moving unit 70 be provided as a vehicle, wheels and the like may be installed at a separate cart or a small engine to easily use the snow removal apparatus 100 on a road on which it is difficult for a vehicle to travel, or the snow removal apparatus 100 having improved dissolution efficiency may be installed as a fixed type without the moving unit 70 to remove snow removed and moved by a dump truck and the like.

Meanwhile, it is preferable that the snow removal apparatus 100 having improved dissolution efficiency of the present invention include a third pump 81 configured to suction the water in the storage tank 20 and supply the water to a water discharge outlet 82, which is configured to discharge the water to the outside and driven by the third auxiliary engine 80, such that the snow removal apparatus 100 having improved dissolution efficiency may be used for various purposes such as a fire truck or water spraying car by using the water discharge outlet 82.

In addition, a pipe line 83 connected to the third pump 81 may also discharge the pumped water to a drain and the like.

Since it is preferable that the above-described snow removal apparatus 100 having improved dissolution efficiency according to the present invention be installed in the moving unit 70, such as a vehicle, to easily be moved, the snow suction unit 10 is operated on a road and the like on which snow is accumulated, and then the stirring portion 11 crushes and stirs wet snow, which contains moisture and is difficult to suction, to convert the wet snow into a state easy to be suctioned, and the wet snow is input to an upper surface of the hopper 30 through the screw 12*a* and the blower 12*b* of the suction portion 12.

In this state, the first auxiliary engine 41 to the third auxiliary engine 80, installed in the loading portion of a vehicle are driven, the first pump 42 to the third pump 81 respectively connected to the first auxiliary engine 41 to the third auxiliary engine 80 are driven, and the first dissolution unit 40 to the third dissolution unit 60 are operated, and thus dissolution efficiency is improved.

When the first pump 42 is driven, the first dissolution unit 40 suctions the water in storage tank 20, sprays the water toward the upper surface of the hopper 30, melts snow on the upper surface of the hopper 30, and the snow falls through the through hole 31 on the bottom of the hopper 30, and the first auxiliary engine 41 to the third auxiliary engine 80 below the hopper 30 circulate exhaust heat exhausted therefrom to melt the snow.

Next, when the second pump 53 is driven, the second dissolution unit 50 suctions the water in the storage tank 20, sprays the water through the venturi tube 51, allows the snow falling from the hopper 30 to pass through the crushing net 54 in front of the venturi tube 51, and crushes snow particles into small pieces.

Next, the heating plate 61 dissolves the snow before snow passing through the venturi tube 51 falls and is stored in the storage tank 20, wherein the heating plate 61 is installed in the third dissolution unit 60, and the exhaust gas pipe line T through which exhaust heat of one among the first auxiliary engine 41 to the third auxiliary engine 80 passes is formed in the heating plate 61.

Meanwhile, when the third pump 81 is driven, the snow removal apparatus 100 having improved dissolution efficiency may be used for various purposes, such as a fire truck or water spraying car, by suctioning the water in the storage tank 20 and supplying the water to the water discharge outlet 82, or discharging the water in the storage tank 20 to a drain and the like through the pipe line 83.

In addition, the heaters H installed in the storage tank 20 are heated to a predetermined temperature and melt snow, and the snow is pumped by the first pump 42 to the third pump 81.

A snow removal apparatus having improved dissolution efficiency according to the present invention can improve dissolution efficiency by rapidly processing dry snow and wet snow through a suction unit and a plurality of dissolution units because snow is dissolved by the first to third dissolution units during a process in which the snow suctioned by the snow suction unit is input to a hopper, and water melted from the snow is stored in a storage tank.

The embodiment of the present invention has been described with reference to the accompanying drawings, and it should be understood that various modifications and other embodiments may be made by those skilled in the art.

[Reference Numerals]

| | | | |
|---|---|---|---|
| 100: | SNOW REMOVAL APPARATUS | | |
| 10: | SNOW SUCTION UNIT | 11: | STIRRING PORTION |
| 12: | SUCTION PORTION | 12a: | SCREW |
| 12b: | BLOWER | 20: | STORAGE TANK |

-continued

| [Reference Numerals] | | | |
|---|---|---|---|
| H: | HEATER | 21: | DISSOLUTION TANK |
| 22: | AUXILIARY TANK | 30: | HOPPER |
| 31: | THROUGH HOLE | 40: | FIRST DISSOLUTION UNIT |
| 41: | FIRST AUXILIARY ENGINE | 42: | FIRST PUMP |
| 50: | SECOND DISSOLUTION UNIT | 51: | VENTURI TUBE |
| 51a: | INLET | 51b: | OUTLET |
| 52: | SECOND AUXILIARY ENGINE | 53: | SECOND PUMP |
| 54: | CRUSHING NET | 60: | THIRD DISSOLUTION UNIT |
| T: | EXHAUST GAS PIPE LINE | 61: | HEATING PLATE |
| 70: | MOVING UNIT | 80: | THIRD AUXILIARY ENGINE |
| 81; | THIRD PUMP | 82: | WATER DISCHARGE OUTLET |
| 83: | PIPE LINE | | |

What is claimed is:

1. A snow removal apparatus having improved dissolution efficiency comprising:

a snow suction unit provided with a stirring portion configured to forcibly crush and stir external snow and a suction portion configured to forcibly suction the snow stirred by the stirring portion;

a storage tank in which a plurality of heaters are installed to melt the snow suctioned by the snow suction unit into water, and which stores the water;

a hopper which is installed above the storage tank, and into which the snow suctioned by the snow suction unit is input;

a first dissolution unit including a first pump configured to suction the water in the storage tank to spray the water onto the snow in the hopper and driven by a first auxiliary engine;

a second dissolution unit including a second pump configured to suction the water in the storage tank and spray the water onto snow falling from the hopper through a venturi tube and driven by a second auxiliary engine wherein the venturi tube, which has an inner fluid passage having a cross section which is smaller than those of an inlet and an outlet thereof, and is installed below a through hole of the hopper; and a third dissolution unit including a heating plate located below the venturi tube and coupled in a zigzag manner to at least one exhaust gas pipe line among exhaust gas pipe lines configured to circulate exhaust heat of the first auxiliary engine and the second auxiliary engine, wherein:

the at least one exhaust gas pipe line among the exhaust gas pipe lines configured to circulate the exhaust heat of the first auxiliary engine and the second auxiliary engine is located below the hopper; and the suction portion is provided with a screw configured to vertically raise the snow crushed by the stirring portion and a blower configured to transfer the snow introduced thereto by the screw to the hopper.

2. The snow removal apparatus of claim 1, further comprising a third pump configured to suction the water in the storage tank and supply the water to a water discharge outlet, which is configured to discharge the water to the outside and driven by a third auxiliary engine.

3. The snow removal apparatus of claim 1, wherein the storage tank is dividable into a dissolution tank and an auxiliary tank, and water is stored in the auxiliary tank when a water level of the dissolution tank is raised.

4. The snow removal apparatus of claim 1, wherein a crushing net is further installed in front of the outlet of the venturi tube.

5. The snow removal apparatus of claim 1, further comprising a moving unit on which the snow suction unit, the storage tank, the hopper, the first dissolution unit, the second dissolution unit, and the third dissolution unit are installable, and which is movable.

6. The snow removal apparatus of claim 5, wherein the moving unit is provided as a vehicle.

7. The snow removal apparatus of claim 1, wherein a heater is installed in the exhaust gas pipe line.

* * * * *